US005890871A

United States Patent [19]

Woerman

[11] Patent Number: 5,890,871

[45] Date of Patent: Apr. 6, 1999

[54] LATCHING MECHANISM FOR A QUICK COUPLER

[75] Inventor: Gary R. Woerman, Wamego, Kans.

[73] Assignee: Caterpillar Inc., Peoria, Ill.

[21] Appl. No.: 987,976

[22] Filed: Dec. 10, 1997

[51] Int. Cl.[6] ..... E02F 3/36

[52] U.S. Cl. ..... 414/723; 37/468

[58] Field of Search ..... 414/723; 37/468; 403/409.1, 328, 322.4, 322.1

[56] References Cited

U.S. PATENT DOCUMENTS

| | | | |
|---|---|---|---|
| 3,556,323 | 1/1971 | Heimmermann | 414/723 |
| 4,116,346 | 9/1978 | Uchida | 414/723 |
| 4,116,347 | 9/1978 | Uchida | 414/723 |
| 4,243,356 | 1/1981 | Takojima | 414/723 |
| 5,147,173 | 9/1992 | Fauber et al. | 414/723 |
| 5,494,396 | 2/1996 | Geier et al. | 414/723 |
| 5,634,736 | 6/1997 | Brown et al. | 403/322 |

OTHER PUBLICATIONS

"Quick Couplers for Cat Hydraulic Excavators"—Balderson Attachments from Caterpillar—Caterpillar Form CE2000 (Aug., 1996).

*Primary Examiner*—Donald W. Underwood
*Attorney, Agent, or Firm*—O. Gordon Pence

[57] ABSTRACT

A quick coupler for detachably coupling a bucket or other work tool to the stick of an excavator or backhoe is disclosed. The quick coupler has a latching mechanism with is powered by a single acting cylinder to unlatch the coupler and which is powered by both a spring device and a gas charged accumulator to latch the coupler to the bucket.

5 Claims, 4 Drawing Sheets

LATCHING MECHANISM FOR A QUICK COUPLER

TECHNICAL FIELD

This invention relates generally to a quick coupler for attaching material handling tools and the like to an earth working machine and, more particularly, to a latching mechanism for such quick coupler.

BACKGROUND ART

In recent years, quick couplers have become commonly used for detachably connecting buckets or other tools to earth working machines, such as backhoes, excavators and loaders. Such quick couplers are advantageous because they allow a machine operator to quickly change from one bucket to another. Of course, the operator can detach and attach other work tools, as well as buckets, for performing other types of work. Thus, the use of a quick coupler makes the machine much more efficient and versatile.

Several different types of quick couplers have been employed in the past. One of such quick couplers is disclosed in U.S. Pat. No. 5,494,396 for a Coupling Device for a Work Implement, issued to Timothy D. Geier et. al. on Feb. 27, 1996. Such coupling device utilizes a manually actuated latching arrangement that requires the operator to wrench out the latching member on the coupling device. Other types of quick couplers are provided with a hydraulically actuated latching mechanism to allow the operator to detach and attach such tools from the cab. One of such quick couplers with a hydraulically actuated latching mechanism is disclosed in U.S. Pat. No. 5,147,173 for a Coupling Device, issued to Raymond L. Fauber on Sep. 15, 1992. In such coupling device, a double acting hydraulic cylinder is employed to both engage and disengage the coupler from the tool. This coupling device also employs a coil spring as a back-up force to the latching wedge in the event hydraulic pressure is lost. Another such quick coupler arrangement is disclosed in U.S. Pat. No. 5,634,736 for a Quick-Disconnect Coupling Device, issued to Eric A. Brown et. al. on Jun. 3. 1997. In this coupling device, a double acting cylinder actuates an over center linkage arrangement to operate the latch. However, no back-up force is provided in the event of the loss of hydraulic pressure.

While prior quick couplers satisfactorily perform their intended task, some are inconvenient because they require the operator to leave the cab to operate them. Others employ double acting cylinders that require two hydraulic lines or are otherwise complex and costly. Others do not employ a back-up system in the event of a loss of the primary latching force.

The present invention is directed at overcoming one or more of the problems set forth above.

DISCLOSURE OF THE INVENTION

In one aspect of the present invention, a latching mechanism is provided for securing a quick coupler to a pair of coupler receiving brackets on a work tool, which brackets have a pair of latching notches provided thereon. A transverse latch bar is carried on the quick coupler and is adapted for movement from an unlatching position wherein the bar is free of the latching notches to a latching position wherein the bar is disposed in latching engagement with the latching notches of the brackets for securing the coupler to the bracket. An actuator mechanism carried on the quick coupler is adapted to move the latch bar between its unlatching position and its latching position. The actuator mechanism includes a hydraulic cylinder that is adapted to provide an unlatching force to selectively move the latch bar to its unlatching position. A mechanical spring device is adapted to provide a first latching force for biasing the latch bar toward its latching position and a gas charged accumulator is adapted to provide a second latching force for biasing the latch bar toward its latching position.

BEST MODE FOR CARRYING OUT THE INVENTION

Figure 1:
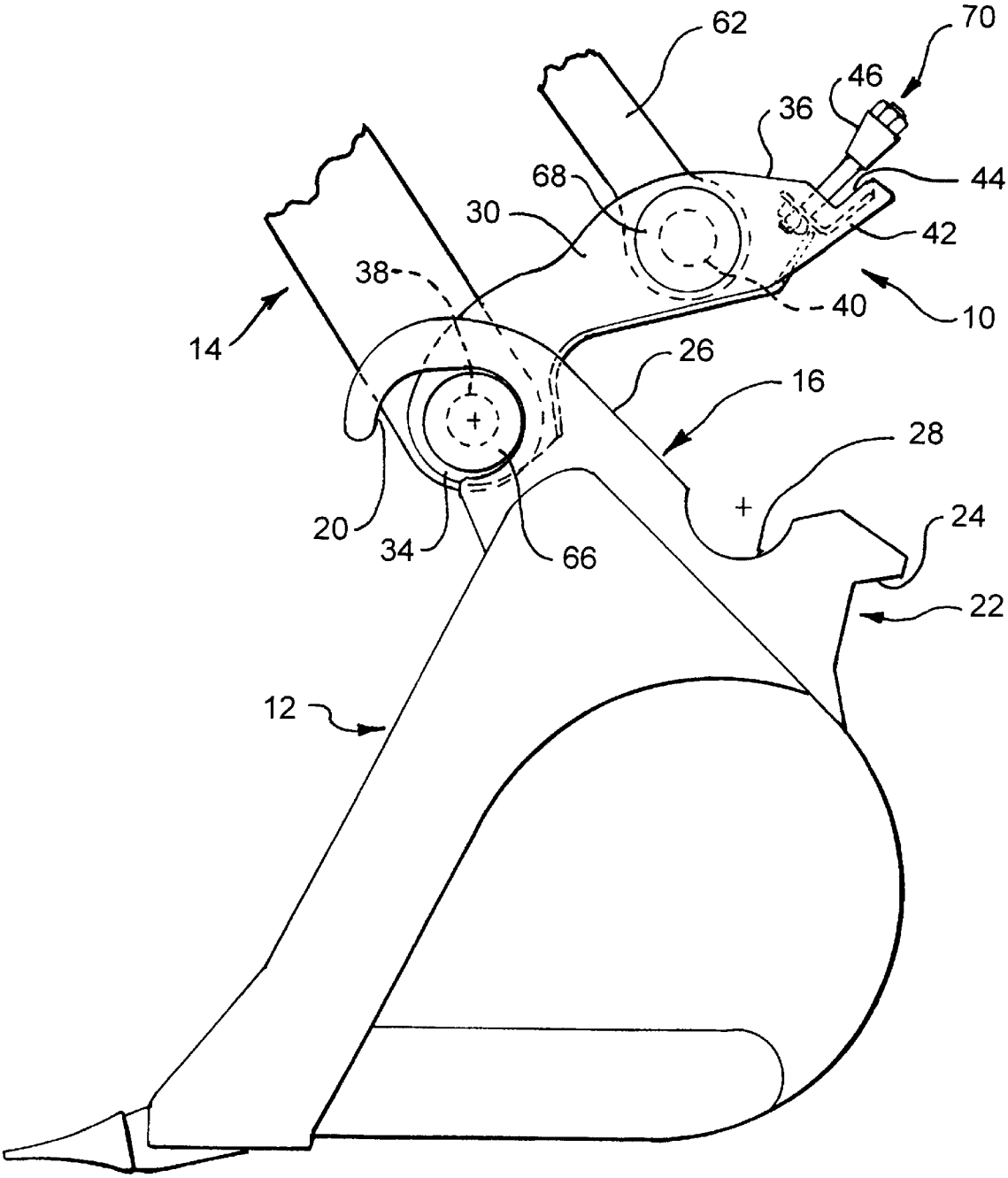
FIG. 1 is a fragmentary side elevational view of a bucket in process of being coupled to a quick coupler having a latching mechanism embodying the present invention.
Figure 2:
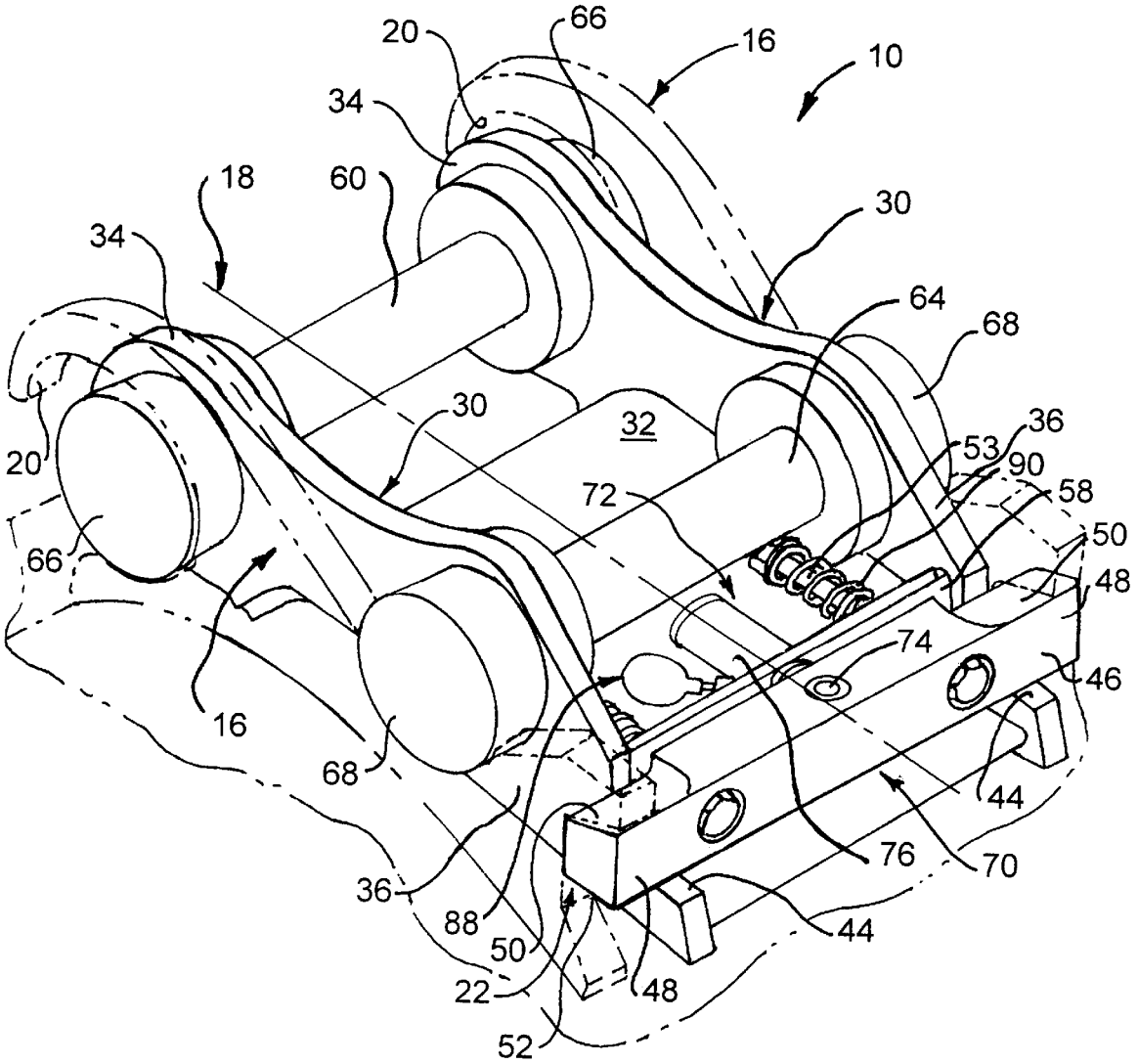
FIG. 2 is a perspective view of the quick coupler shown in FIG. 1, but the stick and linkage removed and the bucket shown in phantom.
Figure 3:
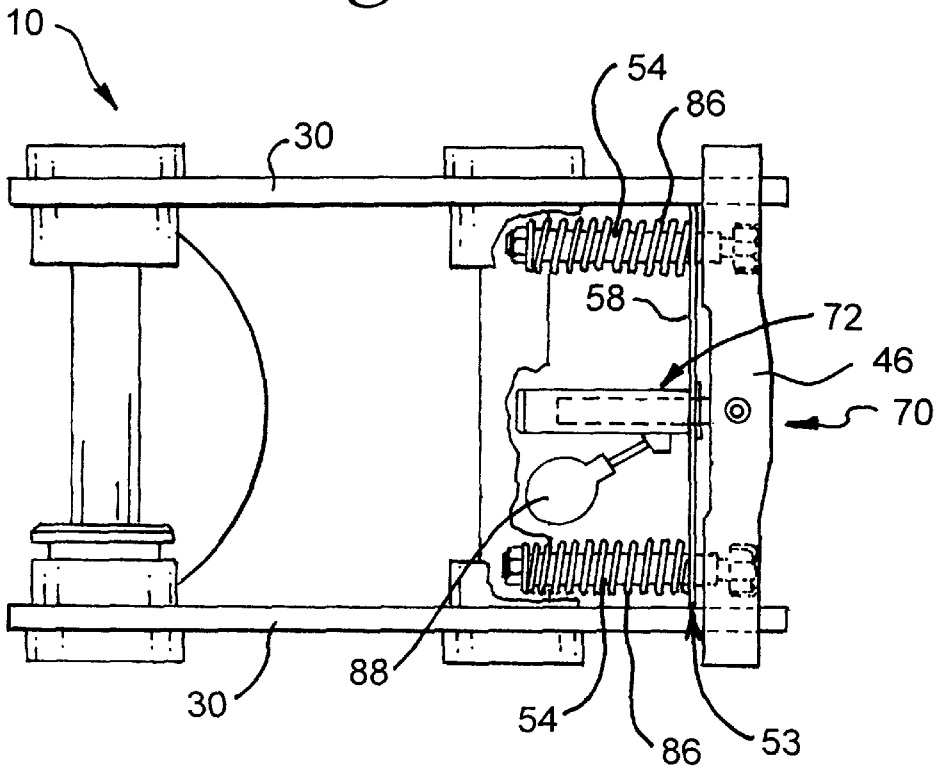
FIG. 3 is a top view of the coupler shown in FIG. 2 with the latching mechanism shown in its latching position.

Referring more particularly to the drawings, a quick coupler embodying the principles of the present invention is depicted at 10 in FIG. 1 for detachably connecting a work tool, such as a bucket 12, to the distal end of a support arm or stick 14 of a work machine, such as a hydraulic excavator (not shown).

The bucket 12 is provided with a pair of upstanding coupler receiving brackets, one of which is shown at 16 in FIG. 1. Brackets 16 are spaced a predetermined distance apart on opposite sides of longitudinally extending axis 18. Each bracket 16 includes one of a pair of an elongated hook openings 20 at one end thereof and one of a pair of latching notches 22 at the other end thereof. Each of the latching notches 22 has an inclined wedge surface 24 thereon. Each bracket 16 also includes an outer edge 26 having one of a pair of generally semi-circular cradle openings 28 formed therein. The brackets 16 are preferably affixed to the bucket by welding.

The quick coupler 10 has a pair of side plates 30, which are connected together by a bottom plate 32. The side plates 30 are laterally spaced a predetermined distance apart on either side of the axis 18 so as to fit between the brackets 16. Each of the side plates 30 has a first end 34 and an opposite second end 36 and is provided with one of a pair of first aligned pin openings 38 located adjacent the first end 34 and one of a pair of second aligned pin openings 40 disposed toward the second end 36. The second ends 36 of each plate 30 are each provided with an extension 42 defining an outwardly facing locking bar abutment surface 44.

The coupler 10 is pivotally connected to the stick 14 by a first pin 60, which is mounted within the first pin openings 38 of the side plates 30. The coupler 10 is also pivotally connected to a pair of links 62 by a second pin 64. Those skilled in the art will appreciate that links 62 are operatively connected through linkage (not shown) to the stick 14 in a well known manner for pivoting the coupler 10 about the first pin 60. A first pair of trunnions 66 and a second pair of trunnions 68 are carried on the coupler 10. The first trunnions are preferably disposed in axial alignment with the first pin 60 and a second pair of trunnions 68 are axially aligned with the second pin 64. The first and second pairs of trunnions 66, 68 are disposed outboard of the side plates 30, with the first pair of trunnions 66 being adapted for receipt within respective ones of the hook openings 20 and with the second pair of trunnions being adapted for receipt within respective ones of the cradle openings 28 of the brackets 16 for mounting the coupler 10 to the brackets 16.

In accordance with the present invention, the quick coupler 10 is provided with a latching mechanism 70 for securing the coupler to the coupler receiving brackets 16 on the bucket 12. Such latching mechanism 70 includes a transverse latch bar 46 and an actuator mechanism 72. The latch bar 46 is carried on the coupler 10 at the second end 36 of the side plates 30. The latch bar 46 has a pair of opposite ends 48, each of such ends 48 having an upper surface 50 which is inclined to match the wedge surface 24 of each of the latching notches 22 and a bottom surface 52 adapted for supporting engagement with the abutment surface 44 of each side plate 30.

A guide mechanism 53 is adapted to reciprocatably mount the latch bar 46 to the quick coupler 10 for movement of the latch bar 46 between an unlatching position wherein the bar is free of the latching notches 22 and a latching position wherein the bar 46 is disposed in latching engagement with the latching notches 22 of the brackets 16 for securing the coupler 10 to the brackets 16. The guide mechanism 53 includes a pair of laterally spaced, elongated guide rods 54 connected to and extending from the latch bar 46. The guide rods 54 are slidably mounted through suitable openings 56 through a laterally disposed mounting plate 58 connected between the side plates 30 so as to slidably mount the latch bar 46 to the coupler 10 for movement of the latch bar 46 in a fore and aft direction generally parallel to axis 18.

The actuator mechanism 72 is carried on the coupler 10 and is adapted to move the latch bar between its unlatching position and its latching position. The actuator mechanism 72 includes a single acting extensible and retractable hydraulic cylinder 76 that is carried on the coupler 10, preferably by being mounted to the mounting plate 58 in any suitable manner. Cylinder 76 is adapted to provide an unlatching force to selectively move the latch bar 46 to its unlatching position and includes a head end 78 and an opposite rod end 80 from which a piston rod 82 extends. The distal end of rod 82 is connected to the latch bar 46 in any suitable manner, such as by a pin 74. An operator actuated control (not shown) of any suitable type well known in the art is employed to selectively direct pressurized fluid through a conduit 84 to the head end 78 to cause the rod 82 to extend and to release such pressurized fluid from the head end 78 to allow the rod 82 to retract. Because cylinder 76 is of a single acting type, only one line or conduit 84 is required to pressurize or depressurize cylinder 76.

Actuator mechanism 72 also includes a mechanical spring device 86, which is adapted to provide a first latching force for biasing the latch bar 46 towards its latching position, and a gas charged accumulator 88, which is adapted to provide a second latching force for biasing the latch bar 46 towards its latching position. The spring device 86 preferably includes a pair of coil compression springs 90, each of which are disposed about a respective one of guide rods 54 and retained between the mounting plate 58 at one end of the spring and a spring retaining washer 92 at the other end of the spring. Each retaining washer 92 is retained by a nut 94 mounted on a threaded end 96 of each guide rod 54. The pair of compression springs 90 are arranged to be compressed when the latch bar 46 is moved to its unlatching position so as to provide the first biasing force for returning the latch bar 46 to its latching position and for maintaining the latch bar 46 in its latching position when fluid pressure is released from the head end 78 of the cylinder 76.

The gas charged accumulator 88 is fluidly connected through a conduit 98 to the rod end 80 of the cylinder 76 and is adapted to supply a predetermined amount of fluid pressure to the rod end 80 to provide a second biasing force for biasing the latch bar 46 towards its latching position and for maintaining the latch bar in its latching position when fluid pressure is released from the head end 78 of the cylinder 76.

Industrial Applicability

Figure 4:
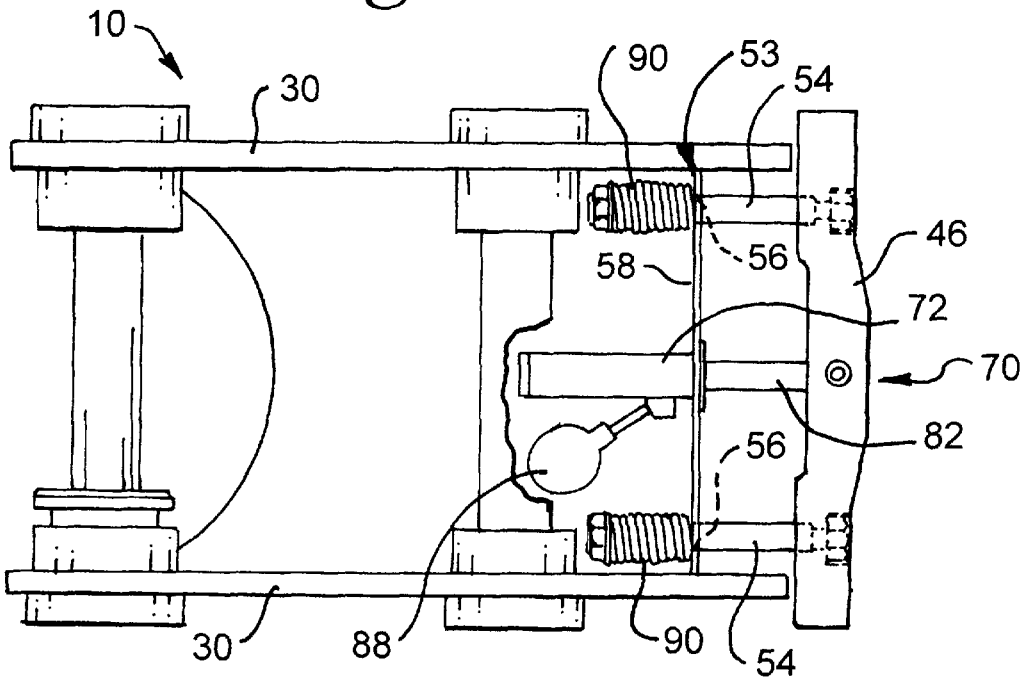
FIG. 4 is a top view similar to FIG. 3, but with the latching mechanism shown in its unlatching position.
Figure 5:
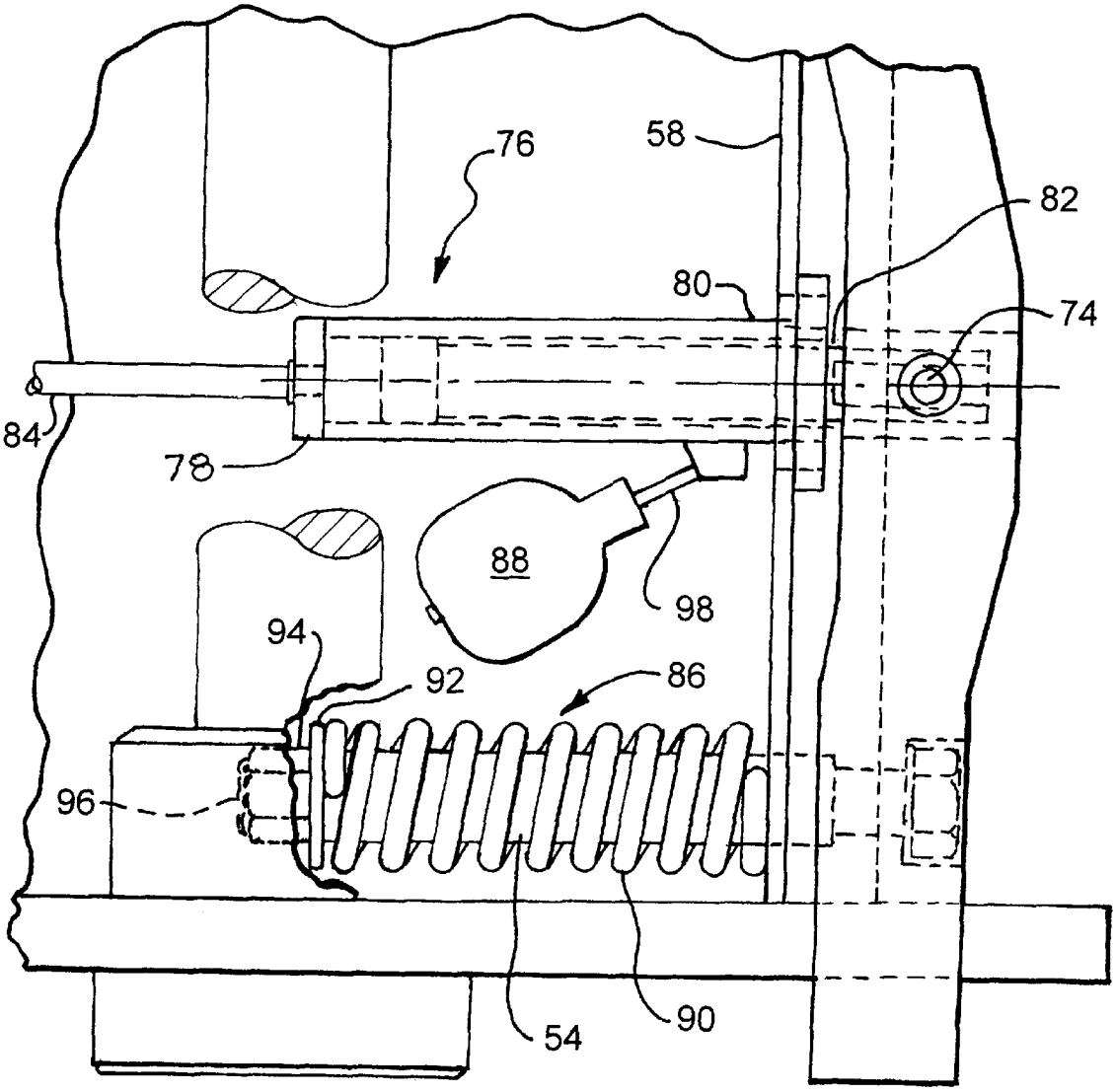
FIG. 5 is an fragmentary view of a portion of the latching mechanism shown in FIGS. 3 and 4.

The latching mechanism 70 constructed in accordance with present invention is extremely effective in attaching and detaching the quick coupler 10 to the coupler receiving brackets 16 on bucket 12 or other work tool. To attach the quick coupler 10 to the bucket 12, the operator operates his latching control to pressurize the latching cylinder 76 so as to move the latch bar 46 to its unlatching position as shown in FIG. 4. The operator then moves the end of the stick 14 so as to position the trunnions 66 within the hook openings 20 of the brackets 16, as shown in FIG. 1. The operator then pivots the coupler 10 about the first pin 60 in a clockwise direction until the second trunnions 68 seat into the cradle openings 28 of the brackets 16. Once this is accomplished, the operator operates his latching control so as to release the fluid pressure from the cylinder 76. Such release of fluid pressure allows the first latching force provided by the springs 90 to move the latch bar to its latching position where the latch bar 46 is seated in the latching notches 22 and where the upper wedge surfaces 50 are in abutting contact with the wedge surface 24 of the brackets 16, thus latching the coupler 10 to the brackets 16. In normal operation, the first latching force is augmented by the second latching force provided by the gas charged accumulator 88, which is effective in supplying fluid pressure to the rod end 80 of the cylinder 76 to cause its retraction. In the event that either the springs 90 or the accumulator become inoperative for any reason, the other of such springs 90 and accumulator 88 are sufficient to move the latch bar 46 to and retain it in the latching notches 22. In addition, the sum of latching forces afforded by both the springs 90 and the accumulator 88 is much greater than the latching force provided by prior devices, due to the lack of space in the coupler to accommodate larger springs.

To detach the bucket 12 from the coupler 10, the operator causes pressurized fluid to be directed through conduit 84 to the head end 78 of the cylinder 76 to effect the movement of the latch bar 46 to its unlatching position shown in FIG. 4. Once this is accomplished, the operator can pivot second trunnions 68 out of the cradle openings 28 and, then, remove the first trunnions 66 from the hook openings 20. A different bucket or other tool can then be attached to and later detached from the coupler 10 by repeating the above sequence.

Other aspects, objects and advantages of this invention can be obtained from a study of the drawings, the disclosure, and the appended claims.

I claim:

1. A latching mechanism for securing a quick coupler to a pair of coupler receiving brackets on a work tool, said brackets having a pair of latching notches provided thereon, comprising:

a transverse latch bar carriable on said quick coupler and adapted for movement from an unlatching position wherein said bar is free of said latching notches to a latching position wherein said bar is disposable in latching engagement with said latching notches of said brackets for securing said coupler to said bracket; and an actuator mechanism carriable on said quick coupler adapted to move said latch bar between its unlatching position and its latching position, said actuator mechanism including a hydraulic cylinder adapted to provide an unlatching force to selectively move said latch bar to its unlatching position, a mechanical spring device adapted to provide a first latching force for biasing said latch bar towards its latching position and a gas charged accumulator adapted to provide a second latching force for biasing said latch bar toward its latching position.

2. The latching mechanism of claim 1 wherein said hydraulic cylinder is a single acting cylinder having a head end and a rod end and being extendible when pressurized fluid is directed to its head end, and wherein said gas charged accumulator is fluidly connected to the rod end of said cylinder and is adapted to supply a predetermined amount of fluid pressure to said rod end for biasing said latch bar toward its latching position.

3. The latching mechanism of claim 1 including a guide mechanism adapted to reciprocatably mount said latch bar for movement between its latching position and its unlatching position.

4. The latching mechanism of claim 2 including means for selectively directing pressurized fluid into said head end of said cylinder for causing said rod end to extend so as to move said latch bar to its unlatching position and for releasing fluid pressure from said head end.

5. A latching mechanism for securing a quick coupler to a pair of coupler receiving brackets on a work tool, said brackets having a pair of latching notches provided thereon, comprising:

a transverse latch bar adapted to be received into said pair of latching notches for latching said coupler to said brackets;

a guide mechanism adapted to reciprocatably mount said latch bar to said quick coupler for movement of said latch bar between an unlatching position wherein said bar is free of said latching notches and a latching position wherein said bar is disposable in latching engagement with said latching notches of said brackets for securing said coupler to said brackets; and an extensible and retractable hydraulic cylinder mountable to said coupler and having a head end and an opposite rod end connected to said latch bar;

means for selectively directing pressurized fluid into said head end of said cylinder for causing said rod end to extend so as to move said latch bar to its unlatching position and for releasing fluid pressure from said head end;

a pair of compression springs that are arranged to be compressed when said latch bar is moved to its unlatching position so as to provide a first biasing force for returning said latch bar to its latching position and maintaining said latch bar in its latching position when fluid pressure is released from the head end of said cylinder; and a gas charged accumulator fluidly connected to the rod end of said cylinder and adapted to supply a predetermined amount of fluid pressure to said rod end to provide a second biasing force for biasing said latch bar toward its latching position and for maintaining said latch bar in its latching position when fluid pressure is released from the head end of said cylinder.

* * * * *